United States Patent [19]

Stram

[11] 3,983,828

[45] Oct. 5, 1976

[54] VERTICALLY MOORED PLATFORM INSTALLATION

[75] Inventor: Edward M. Stram, San Rafael, Calif.

[73] Assignee: Standard Oil Company (Indiana), Chicago, Ill.

[22] Filed: Jan. 5, 1976

[21] Appl. No.: 646,723

[52] U.S. Cl. ..... 114/.5 D; 61/89; 175/7

[51] Int. Cl.[2] ..... B63B 35/44

[58] Field of Search ..... 114/.5 D, 206 R; 61/46.5, 46, 50; 175/5, 7

[56] References Cited

UNITED STATES PATENTS

| | | | |
|---|---|---|---|
| 3,209,544 | 10/1965 | Borrmann | 114/.5 D |
| 3,457,728 | 7/1969 | Pogonowski | 61/46.5 |
| 3,839,873 | 10/1974 | Loire | 61/46.5 |
| 3,896,628 | 7/1975 | Hansen | 61/46.5 |

*Primary Examiner*—Trygve M. Blix
*Assistant Examiner*—Stuart M. Goldstein
*Attorney, Agen* ~ *Firm*—John D. Gassett

[57] ABSTRACT

This invention relates to the installation of a vertically moored platform over a selected well site. The platform or structure is supported on a buoyant gravity base and floated to a position over the subsea wall site. The gravity base is attached or held to the platform by a plurality of short sections of riser pipes. The gravity base is then ballasted to give it a negative buoyancy. A joint of riser pipe is then added to each of the short riser pipe sections. The gravity base is then lowered by lowering all the riser pipes simultaneously until the top of the newly added joints is reached. Then a second group of riser joints is added and the process repeated until the gravity base has been lowered to the ocean floor. When the gravity base has reached bottom, heavy ballasting material, such as cement slurry, can be added if needed. The riser pipes which were used to lower the gravity base are the riser pipes which anchor the floating platform to the gravity base which serves as an anchor. It is also through these riser pipes that drilling operations are conducted.

3 Claims, 8 Drawing Figures

VERTICALLY MOORED PLATFORM INSTALLATION

BACKGROUND OF THE INVENTION

1. Field of the Invention

This invention relates to the installation of a structure floating on a body of water. More particularly, the invention relates to a floating structure from which drilling or production operations are carried out. It relates especially to the installation of vertically moored platforms (VMP) in deep water.

In recent years there has been considerable attention atracted to the drilling and production of wells located in water. Wells may be drilled in the ocean floor from either fixed platforms in relatively shallow water or from floating structures or vessels in deeper water. The most common means of anchoring fixed platforms includes the driving or otherwise anchoring of long piles in the ocean floor. Such piles extend above the surface of the water and support a platform attached to the top of the pile. This works fairly well in shallow water; but, as the water gets deeper, the problems of design and accompanying costs become prohibitive. In deeper water, it is common practice to drill from a floating structure.

In recent years, attention has been directed toward many different kinds of floating structures. One system receiving attention is the vertically moored platform. Such a platform is described in U.S. Pat. No. 3,648,638, issued Mar. 14, 1972, Kenneth A. Blenkarn, inventor. Key features of the disclosure in that patent are that the floating platform is connected to an anchor on the ocean floor only by elongated parallel members and the floating structure has buoyant means designed especially with respect to the trough of a design wave so as to minimize mooring forces imposed on the vertically elongated members which anchor the structure, such as those forces which may be caused by passing waves.

The closest or most pertinent prior art of which I am aware is the aforesaid U.S. Pat. No. 3,648,638. However, the installation described here is for a different method from the installation method and system described in that patent.

BRIEF DESCRIPTION OF THE INVENTION

Briefly, a preferred embodiment of this invention concerns a vertically moored platform having limited lateral movement for use in a body of water. The floating structure, including a work deck, sits on a gravity base, and the two are floated as a unit to the selected location. The gravity base can be a large compartmentalized tank and when lowered to the sea floor, serves as an anchor block. In a typical vertically moored platform, there are four main bottle-shaped buoyant means which are spaced to form a rectangle. A bundle of riser pipes goes through each of these corners to a gravity base section directly under the associated major buoyant means. These riser pipe sections hold the gravity base to the platform structure.

A ballasting procedure is then followed to give all four sections of the gravity base a negative buoyancy. Then additional joints of riser pipe are connected to each of the riser pipe sections which are connected to the gravity base. These additional joints of riser pipes all entered upwardly above the platform deck. "Joint" is oilfield terminology for a section of pipe. Then, special jacking means and clamping means are provided to lower all the additional riser joints simultaneously. This causes all sections of the gravity base to be lowered an equal distance. When the gravity base has been lowered a distance approximately equal to the length of a joint of riser pipe, a second group of additional joints of riser pipe are added to each of the first joints of riser pipe. Then the lowering procedure is repeated. This sequence is repeated until the gravity base rests on the bottom of the ocean floor. At this time, a heavy weighted fluid, such as cement slurry, can be added to the gravity base to aid in forming an anchor for the system.

DRAWINGS

A better understanding of the invention may be had from the following description taken in conjunction with the drawings in which.

DETAILED DESCRIPTION OF THE INVENTION

Figure 1:
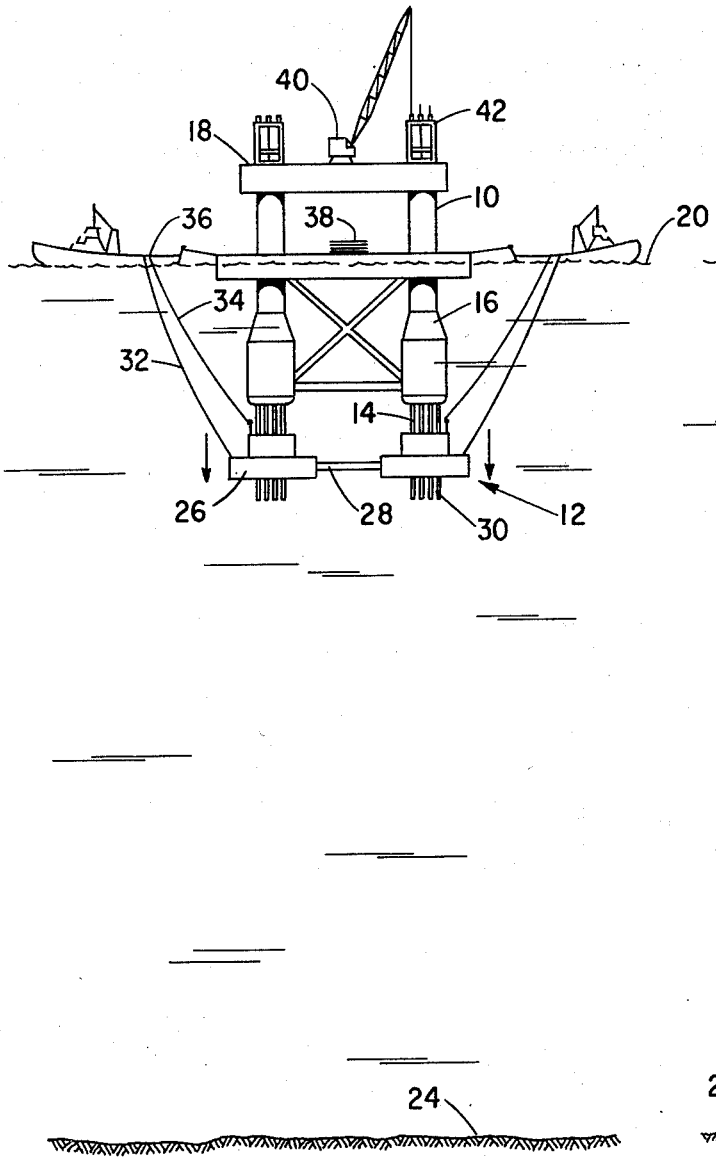
FIG. 1 shows a view of the vertically moored platform attached to the gravity base by riser pipes and on location.

Attention is next directed to the drawings, and in particular FIG. 1, which illustrates a vertically moored platform generally designated 10 with a gravity base 12 supported from the structure 10 by a plurality of short riser pipe sections 14. The buoyancy means or legs 16 of the platform supports a working deck 18 above the surface 20 of the body of water 22 which has a bottom 24. The deck 18 is usually rectangular in shape and may be a square. The gravity base 12 has four sections 26, one under each of the corners of the platform 18. There is normally buoyant means 16 under each corner of the platform 18. The buoyancy means are preferred to be bottle-shaped. The gravity base sections 26 are held together by cross-bracing 28 which holds the gravity base 12 in a fixed configuration of four sections 26 which are under each leg 16. Each gravity base section 26 is normally composed of a plurality of compartmentalized tanks. There are a plurality of hoses 32 and 34 which go to a supply ship 36. These lines are used for adding fluid or ballast to the individual tanks of the gravity base and for opening and closing valves as necessary, all of which can be done in a known manner. Each gravity base section 26 has a plurality of punch tubes 30 to which the riser pipes 14 extend.

Also shown in FIG. 1 are a plurality of riser pipe joints 38 and a crane 40. Also shown on platform 18 is a hydraulic or other jacking system 42 which will be described more in relation to FIGS. 3 and 4.

Figure 2:
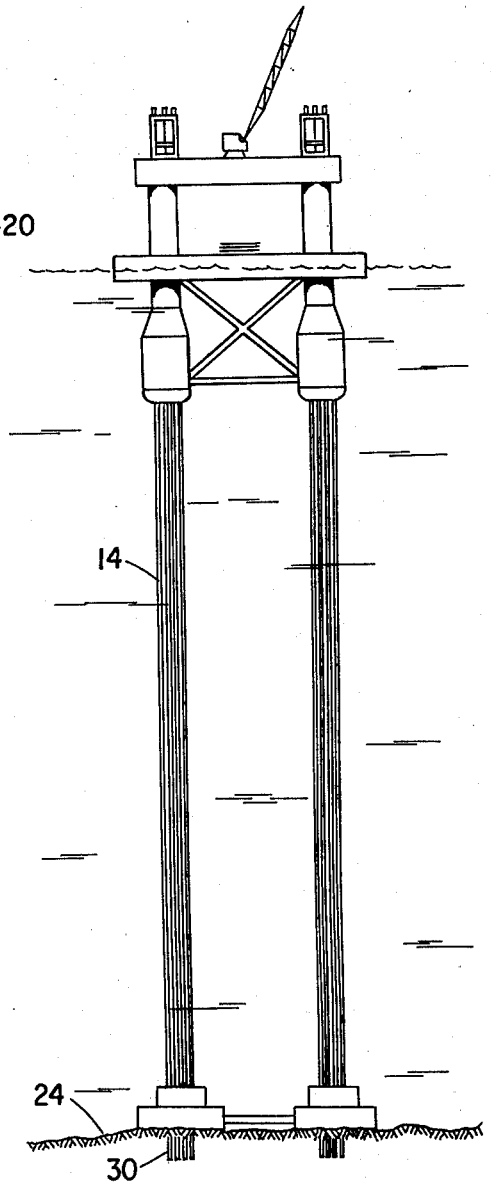
FIG. 2 is the same structure as FIG. 1, except all the joints of riser pipe have been added so that the gravity base rests on the bottom.

FIG. 2 is similar to FIG. 1, except it illustrates the vertically moored platform after all joints of the riser pipes 14 have been added and in the manner previously mentioned but to be more fully explained hereinafter until the gravity base 12 rests on a floor 24. In this figure, the punch tubes 30 have been extended into the ocean floor. These punch tubes 30 are forced by the weight of the gravity base to sea floor 24. Drilling operations can be conducted through these punch tubes and the riser pipes. In FIG. 2, the lines 32 and 34 have been removed; however, before they were removed, any fluid, such as cement slurry, as believed necessary to give the gravity base 12 the proper ballast was injected.

I shall next describe a sequence of steps which is repeated until the device in the stage shown in FIG. 1 becomes that of FIG. 2. The sequence of steps can perhaps best be illustrated by reference to FIGS. 5, 6, 7, and 8. There is shown in each figure a fragmented view in illustrative form of the platform and a part of the gravity base section with jack and one riser pipe. Shown thereon in simplified illustration form is platform 10A and gravity base section 26A.

Figure 5:
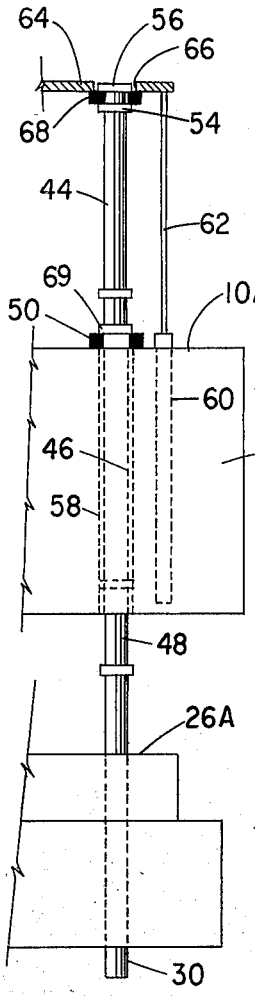
FIG. 5 illustrates one joint of riser pipe added to one of the riser pipes shown in FIG. 1 supporting the gravity base and with the jacking means in its upper position.

Referring to FIG. 5, shortly after I arrive at the selected location, I connect a joint 44 of riser pipe to each of the existing joints 46 which are connected to short joints 48 which are connected to the gravity base section 26A. The lengths of joints 46 and 48 will be sufficient so that the top of the joint 46 is supported by clamps 50 at the top of deck 10A and the lower end of the joint of riser pipes will connect to the gravity base section 26A. This part of the riser pipe can be made as two sections 46 and 48 or as a single section and is made up in the dry dock or other constructing facilities. The upper end of joint 44 is connected to a spool 52 which has a lower shoulder 54 and an upper shoulder 56. Platform 10A has a vertical opening 58 for each riser pipe to be installed.

Attention is next directed to the elevators or jacking mechanism of FIGS. 5, 6, 7, and 8. Shown in FIG. 5 is a hydraulic piston and cylinder 60 having upper extending rod 62 which is connected to and supports a lifting platform 64. This lifting platform 64 has a plurality of openings 66, one for each riser pipe 44. Connected to lifting platform 64 beneath the opening 66 is an upper clamp 68. Details of this clamp will be explained more fully, but it is a clamp that can be moved inwardly and supports shoulder 56 of the riser pipe. Lower clamps 50 are secured to the platform 10A itself and are shown as supporting riser 44 but through a lower shoulder 69. Thus, in FIG. 5 I show a portion of the gravity base 26A which is supported from the platform 10A by a plurality of joints 48, 46, and 44 of riser pipes. These riser pipes are selectively supported by clamps 50 and 68.

Figure 6:
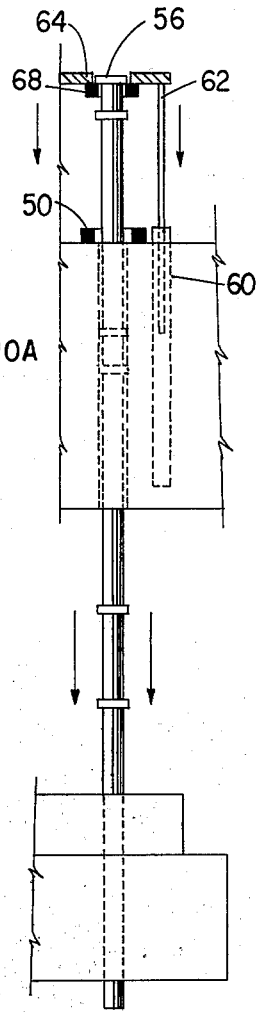
FIG. 6 illustrates the next sequence from the view of FIG. 5 and shows the jacks having lowered the riser and gravity base approximately one-half the length of additional joint of riser pipe.

The next procedure is to loosen clamps 50 so that they do not support shoulders 69. This retracted position is shown in FIG. 6. At this stage, only clamps 68 are operative, and the power to hydraulic ram 60 is such as to retract or lower arms 62. As can be seen, the gravity base 26A is lowered a corresponding amount to that of the lowering of riser section 44.

As shown there, the lower clamps 50 have been released and the riser pipe section 44 is supported through clamp 68 which is activated. It is to be remembered that while I show only one riser pipe 44, that I am doing the same thing simultaneously for all of the riser pipes on all of the corners of the platform.

Figure 7:
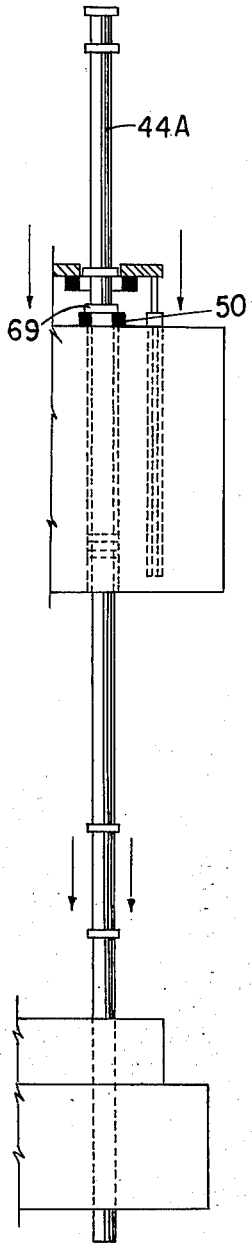
FIG. 7 is the next sequence from FIG. 6 and shows the top joint of FIG. 6 completely lowered to the bottom of the jack stroke and an additional joint of riser pipe added.
Figure 8:
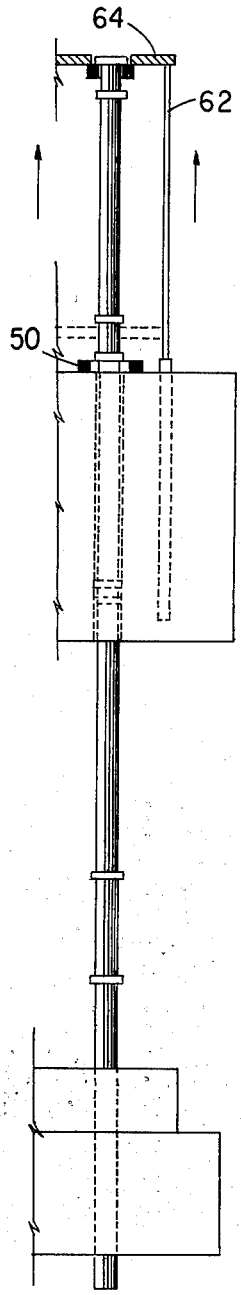
FIG. 8 is the next sequence of steps and shows the elevator or jacking system in its upper position engaging the latest added joint of riser pipe.

I continue lowering the riser pipes 44 until I reach position shown in FIG. 7. This time, I then add additional joint of riser pipe 44A. At this time, it is seen that the lower clamp 50 is activated and is supporting the riser pipes and upper or lifting clamp 68 has been retracted. For the next sequence step, I refer to FIG. 8 which shows lifting table 64 extended to its uppermost position. At this time, I release lower clamps 50 as indicated in FIG. 8 and then lower the riser pipes. These sequences of steps illustrated in FIGS. 5, 6, 7, and 8 are repeated until the gravity base 12 rests on the bottom of the body of water as illustrated in FIG. 2.

Figure 3:
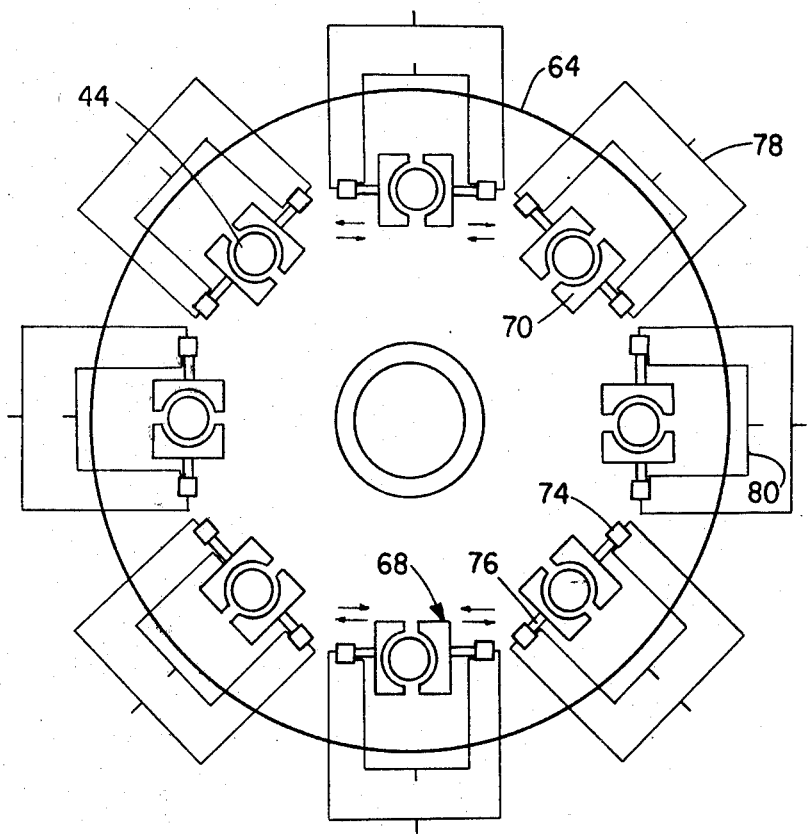
FIG. 3 is an enlarged view of a suitable riser pipe clamp and lowering system of FIG. 1.
Figure 4:
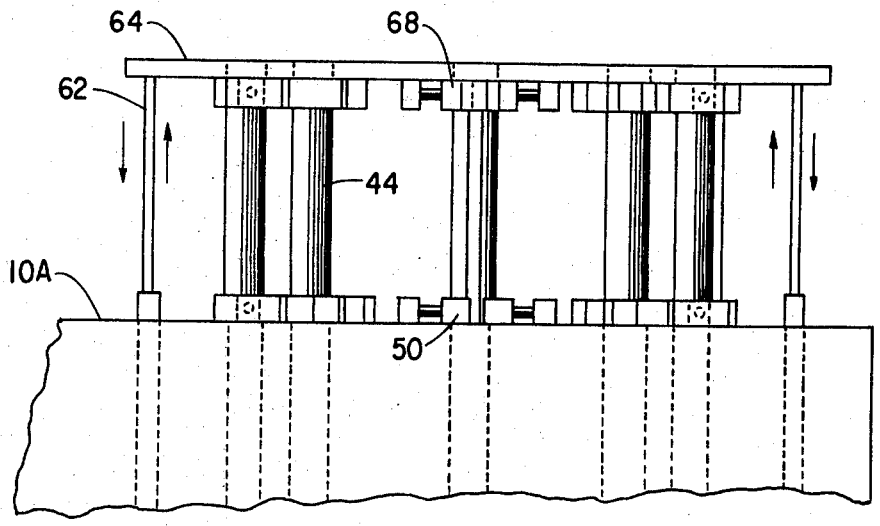
FIG. 4 is a vertical plan view of the jacketing and clamping mechanism of FIG. 3.

FIGS. 3 and 4 illustrate one arrangement of a lifting mechanism and lowering mechanism for the risers at each corner of the vertically moored platform. Shown thereon is support or lifting table 64 and a plurality of upper clamps 68. As shown more clearly in FIG. 3, each clamp 68 includes two clamp sections 70 with a half circle 72 cut out, a hydraulic drive 74, and a ram or rod 76 connected to clamp 70. Motor 74 is double acting and by applying fluid pressure to line 78, the clamps are driven shut and by applying fluid under pressure to line 80, the clamp sections 70 are retracted. These can be done in any conventional manner. A riser pipe section 44 extends through each of the eight clamps shown in FIG. 4. In FIG. 4, one can see the vertical arrangement of the lower clamps 50 on deck 10A, risers 44, upper clamp 68, lifting table 64, and jack rods 62. All clamps 68 and 50 can open sufficiently to permit passage of shoulder 54, 56 of the riser pipes.

After the device is set, as shown in FIG. 2, drilling operations are conducted downwardly through riser pipe 14 and its associated punch tube 30 into the ocean bottom therebeneath.

Various modifications can be made to the above described invention without departing from the spirit or scope thereof.

What I claim:

1. A method of installing a floating structure at a selected location on the floor of a water-covered area which comprises:

a. positioning said floating structure and a gravity base over said location;

b. securing said gravity base to a plurality of first joints of riser pipes;

c. releasably supporting said first joints of riser pipes from said floating structure so that said gravity base is supported above the bottom of said body of water from said floating structure;

d. connecting each of a plurality of second joints of riser pipes to each of the plurality of said first joints;

e. supporting said plurality of second joints of riser pipes and releasing the support of said plurality of said first joints;

f. lowering said gravity base by lowering said plurality of joints of riser pipes;

g. repeating steps (d), (e), and (f) until the gravity base is on the bottom of the body of water.

2. A method as defined in claim 1 including the step of drilling a well through each said riser pipe.

3. A method as defined in claim 1 including the step of adding a heavy fluid to the interior of said gravity base.

* * * * *